US008245951B2

(12) United States Patent
Fink et al.

(10) Patent No.: US 8,245,951 B2
(45) Date of Patent: Aug. 21, 2012

(54) ELECTROSTATIC ATOMIZING FUEL INJECTOR USING CARBON NANOTUBES

(75) Inventors: Richard Lee Fink, Austin, TX (US); Nan Jiang, Austin, TX (US)

(73) Assignee: Applied Nanotech Holdings, Inc., Austin, TX (US)

( * ) Notice: Subject to any disclaimer, the term of this patent is extended or adjusted under 35 U.S.C. 154(b) by 223 days.

(21) Appl. No.: 12/428,292

(22) Filed: Apr. 22, 2009

(65) Prior Publication Data

US 2009/0261186 A1 Oct. 22, 2009

Related U.S. Application Data

(60) Provisional application No. 61/046,859, filed on Apr. 22, 2008.

(51) Int. Cl.
*B05B 5/025* (2006.01)

(52) U.S. Cl. ..... 239/5; 239/3; 239/533.3; 239/533.12; 239/585.1; 239/575; 239/690; 123/538; 60/273; 60/276

(58) Field of Classification Search ..... 239/3, 5, 239/533.3, 533.8, 533.9, 533.12, 584, 585.1, 239/575, 690, 704, 708, DIG. 23; 123/491, 123/538; 60/273, 276
See application file for complete search history.

(56) References Cited

U.S. PATENT DOCUMENTS

| | | | | | |
|---|---|---|---|---|---|
| 4,150,644 | A * | 4/1979 | Masaki et al. | ..... | 123/538 |
| 4,508,265 | A * | 4/1985 | Jido | ..... | 239/3 |
| 5,086,972 | A * | 2/1992 | Chang et al. | ..... | 239/3 |
| 5,234,170 | A * | 8/1993 | Schirmer et al. | ..... | 239/690 |
| 5,671,716 | A * | 9/1997 | Hetrick et al. | ..... | 123/491 |
| 5,725,151 | A | 3/1998 | Hetrick et al. | | |
| 7,198,208 | B2 * | 4/2007 | Dye et al. | ..... | 239/708 |
| 7,810,314 | B2 * | 10/2010 | Brahma et al. | ..... | 60/276 |

* cited by examiner

*Primary Examiner* — Steven J Ganey
(74) *Attorney, Agent, or Firm* — Kelly Kordzik; Matheson Keys Garsson & Kordzik PLLC

(57) ABSTRACT

Use of carbon nanotubes (CNTs) in a charge injector to assist in atomizing fuel for engine applications. A CNT charging unit is positioned in front of a fuel injector. A voltage is applied on a CNT coated mesh to charge the fuel stream when it passes. Then the charged stream goes through a grounded metal cage. The fuel is thereby electrostatically charged causing repulsive forces on surfaces of liquid in the fuel resulting in the liquid splitting into droplets.

10 Claims, 3 Drawing Sheets

ELECTROSTATIC ATOMIZING FUEL INJECTOR USING CARBON NANOTUBES

This application claims priority from U.S. Provisional Patent Application Ser. No. 61/046,859.

TECHNICAL FIELD

The present invention relates to fuel injectors, and more particularly, to use of carbon nanotubes in a fuel injector.

BACKGROUND

There are many current and future military applications where small (~5 hp) spark ignition engines are desirable, such as UAV (unmanned aerial vehicle) propulsion. Typically, these engines operate on gasoline fuel, but the DOD (Department of Defense) has directed that all land-based ground and air forces use a single fuel with JP-8 as the leading candidate (see MIL-DTL-83133E, "Detailed Specification—Turbine Fuels, Aviation, Kerosene Type, NATO F-34 (JP-8), NATO F-35, and JP-8+100," Apr. 1, 1999). JP-8 is a high flash point fuel that requires atomization to a small droplet size in order to burn properly in an internal combustion engine. As will be discussed below, this can be achieved with high pressure atomizers, but these are not practical for small engine applications.

DETAILED DESCRIPTION

Electrostatic atomization techniques have demonstrated fine droplet atomization of fuels. Another advantage is that electrostatic injection can be driven in a pulsed mode to synchronize with the engine operating cycle. The present invention uses carbon nanotubes (CNTs) as a charge injector to assist in atomizing fuel (e.g., JP-8) for engine applications.

This technology also has significant dual use applications. Future aircraft and automobiles need highly improved propulsive power plants to achieve their performance goals; high-efficiency engines with low-level exhaust emissions are strongly demanded. The fuel atomization as part of the fuel injection process is a critical factor influencing engine efficiency and pollutant emission. A finer fuel mist allows a more efficient burn of the fuel, resulting in less harmful emission. This is attributed to the fact that combustion starts from the interface between the fuel and air. By reducing the size of the fuel droplet, the surface area is increased at the start of combustion, boosting the combustion efficiency and improving emission quality. See R. Tao. "Electric-Field Assisted Fuel Atomization"; and http://www.stwa.com/images/E-Spray.pdf. In parallel, in order to further improve the engine performance, pulsed control techniques such as pulsed detonation and pulsed injection have been developed. Correspondingly, an atomizer should not only make fine droplets but also have a pulsed operation capability. Specifically, the atomizers need to split fuel into tiny droplets within a short period of time and be compatible with on/off operation. It has been reported that droplets as small as 3 μm would be required for pulsed detonation engines. C. M. Brophy et al. 36th AI AA/ASME/SEA/ASSEE Joint Propulsion Conference, 17-19, Jul. 2000, Huntsville, Ala., AI AA paper 2000-3591.

The characteristics of the fuel atomizers with respect to small scale engines are:

1. Strong atomization ability to split fuel into fine droplets (3 μm or less).
2. Low fuel pressure operation (less than 3 bar).
3. Capable of pulsed operation.
4. Low parasitic power consumption (high efficiency).
5. Simple and low-cost.

Figure 1A:
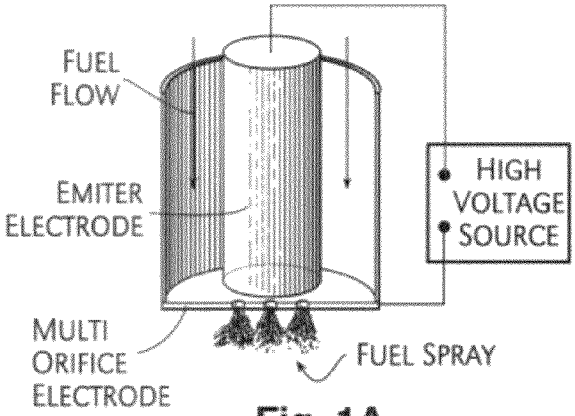
FIG. 1A illustrates a planar type charging unit with multiple exit orifices.
Figure 1B:
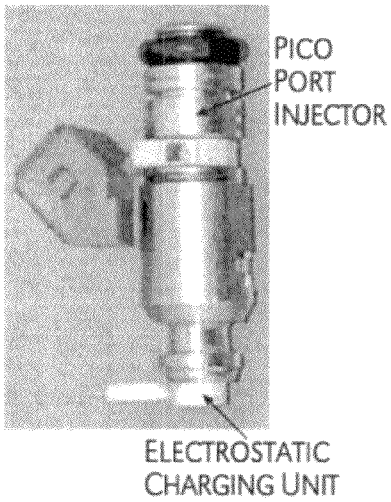
FIG. 1B depicts the charging unit of FIG. 1A assembled on the outlet of a fuel injector.

An electrostatic atomization technique may be used for achieving a fine fuel mist. See J. S. Shrimpton and A. R. H. Right, Atomization and Spray, Vol. 16, pp. 421-424 (2006); W. Lehr and W. Hiller, Journal of Electrostatics, Vol. 30, pp. 44-440 (1993); and J. S. Shrimpton and Y. Laoonual, Intl. J. for Numerical Methods in Engineering, Vol. 67, pp. 1063-1081. One method atomized hydrocarbon fluid by applying a high voltage on a metal needle with a sharp point located at the injector outlet (A. J. Yule et al., Fuel, Vol. 74, pp. 1094-1103-(1995)). The fluid was atomized immediately on exiting the charging unit. But, this single sharp point charging unit had significant alignment and flow-rate limitation problems. To overcome these problems, a planar type charging unit was developed with multiple exit orifices as illustrated in FIG. 1A. This charging unit was assembled on the outlet of a fuel injector as shown in FIG. 1B. (see Jeffrey Allen and Paul Ravenhill, SEA 2005, Paper 2005-32-0090) This assembly, successfully obtained 27 μm diameter droplets using a flow pressure of under 2 bar. The applied voltage was 6 kV and the orifice opening was 60 μm.

The basic process of electrostatic atomization is to charge the liquid with a strong electric field. When the repulsive forces between the like charges on the liquid surface exceed the surface tension, the liquid will split into droplets, so-called Rayleigh fission. From a quantum mechanical basis, the amount of charge on each small droplet that is separated from others by an electrical force can be roughly estimated by dividing the droplet diameter by the radius of Bohr's quantum mechanical model of the hydrogen atom (0.53 Å). A. J. Kelly, R&D Innovator, Vol. 3, No. 8, Article #113 (1994). Consequently, the modeling results indicate that if the droplet diameter is as small as 3 μm, the electron charge delivered from the charging unit is expected to have a density of over $10^{16}$ electrons/$cm^3$.

Electrostatic atomization offers a number of advantages over more conventional methods. Electrostatic atomization usually needs very little power to operate; power consumption is typically less than 1 W (kilovoltages, micro-ampere currents). On the other hand, charged droplets are naturally self-dispersive thereby avoiding droplet agglomeration that can occur in a conventional uncharged spray. See H. Okuda and A. J. Kelly, Phys. Plasmas, Vol. 3, pp 2191-2196 (1996). Furthermore, the direction of a highly charged stream can be controlled or adjusted by subsequent electromagnetic forces, allowing one to directly pull the fuel stream into a combustion chamber for a Direct Injection Spark Ignition (DISI) cycle without using high pressure air to achieve penetration. Uncharged droplets do not allow for this option.

In the electrostatic charging process, the electrical field plays a key role, both to inject the charge into the fuel and to split the fuel into smaller droplets, as explained above. The electrical field used to inject charge into the fuel should be so strong that electrons and ions can be expelled from the droplet surface. Droplet size is inversely proportional to the square of electrical field. Id. To improve electrostatic atomization, one should first find a way to efficiently enhance the charge injection electrical field.

Figure 5:
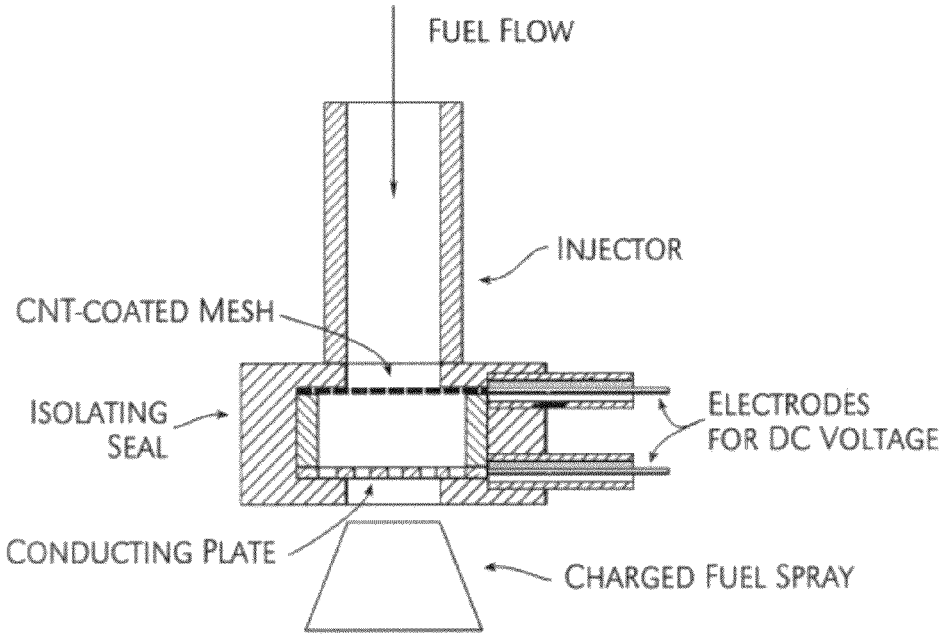
FIG. 5 illustrates a diagram of a charging unit on a fuel injector.

Other configurations of the assembly shown in FIG. 5 are also possible. It is possible to reverse the placement of the CNT-coated mesh with the conductive plate. It is also possible to have the mesh and the conductive plate in the positions as shown in FIG. 5, but with the CNT coating on the conductive plate instead of on the mesh. In this case, the CNT coating can be on both sides of the plate and inside the hole but it is critical that at least the side facing the mesh is coated with CNTs. In both of these alternative configurations, the bias polarity may be with the CNT-coated part (either mesh or conducting plate) biased negative (−) with respect to the other electrode.

Figure 2:
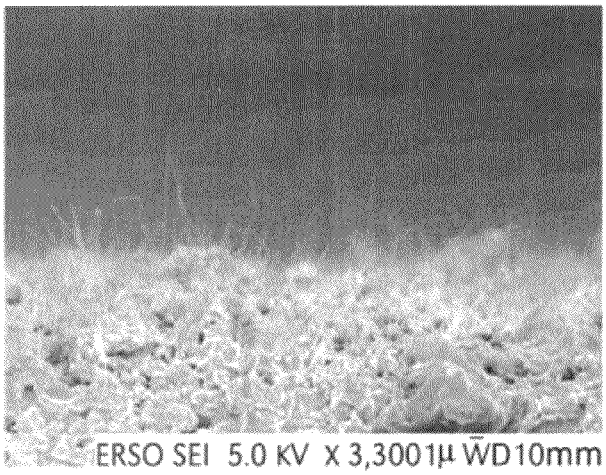
FIG. 2 is a digital photograph showing that CNTs have strong electric field enhancement due to their high aspect ratio.
Figure 3:
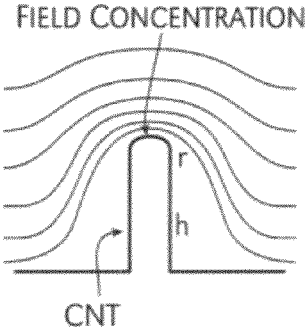
FIG. 3 illustrates that a large β enhancement factor concentrates the electric field at the ends of nanotubes.
Figure 4:
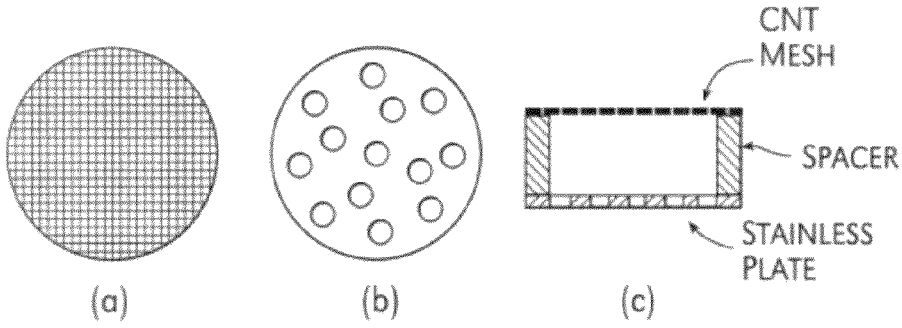
FIG. 4 illustrates CNT films deposited on metal mesh surfaces to produce charging units.

CNTs have strong electrical field enhancement due to their high aspect ratio, as shown in FIG. 2. The field enhancement factor β of CNT films can reach as high as 5000. CNT films are deposited on metal mesh surfaces to produce charging units, as shown in FIG. 4. Allen and Ravenhill showed (see Jeffrey Allen and Paul Ravenhill, SEA 2005, Paper 2005-32-0090) that in order to increase the electrical field, they reduced the anode-cathode gap of their charge injector to 10-120 μm. Such a narrow gap requires precise adjustment and alignment of the two plate-type electrodes, which is a complicated and costly process. Any small deviation in alignment out of parallel will cause serious field non-uniformity. Because of the large β enhancement factor that concentrates the electrical field at the ends of nanotubes (see FIG. 3), such a fine gap is not required. By coating one of the two plates with a CNT film, the electrical field strength near the CNT film is enhanced dramatically. Assuming the same high voltage (6 kV, used by Allen and Ravenhill) is applied, even if the gap is increased to the millimeter level, one can still obtain an electrical field at the CNT surface that is over two orders of magnitude larger. Of course, the larger anode/cathode gap makes the unit simple and easy to control. Meanwhile, the greatly enhanced field reduces the droplet size from 27 μm (see Jeffrey Allen and Paul Ravenhill, SEA 2005, Paper 2005-32-0090) to less than 3 μm at a low pressure by using the CNT charging technique. Moreover, CNTs make excellent field electron emitters. See J. M. Bonard et al., Appl. Phys. Lett., Vol. 78, pp. 2775-2777 (2001); and M. Grujicic et al., Appl. Surf. Sci., Vol. 206, pp. 167-177 (2003). When the negative high voltage is applied on the CNT film, the strong fields formed at the CNT sharp tips not only expel ions from the droplet surface, but also force the electrons to emit from tips of the CNTs to further charge the droplets. Such a comprehensive effect atomizes the fuel stream quite well. Another important advantage of CNTs is their rapid electrical response; field electron emission pulse rates in the MHz range is not an issue. See W. B. Choi et al., Appl. Phys. Lett., Vol. 75, pp. 3129-3131 (1999). Such a high speed is quite sufficient for the engine pulse rates (60-100 Hz).

In summary, the CNT-based electrostatic charging unit has the following merits:

Extremely high electrical field enhancement.

Field electron emission assisted atomization.

Rapid pulse response.

Simple structure, low-cost, low-power consumption and compatible with low pressure atomization.

Single-wall carbon nanotubes (SWCNTs), double-wall carbon nanotubes (DWCNTs), and multi-wall carbon nanotubes (MWCNTs), and mixtures of these materials may be used in CNT-based electrostatic atomizers.

CNT films can be deposited on metal wire mesh substrates with various opening sizes and opening ratios. These parts are obtainable from small parts catalogs.

There are many ways to prepare the CNT films. Two approaches are:

a) Printing a CNT-based paste made with a low-outgassing, inorganic binding.

b) Spraying on a CNT-based ink.

The formulations for these materials have been presented in previous patent applications, such U.S. application Ser. No. 11/124,332 and U.S. Pat. No. 7,452,735, which are hereby incorporated by reference herein. These formulations are used to deposit CNT materials onto the metal mesh substrates, using a low out-gassing binder to anchor the nanotubes to the substrate. The next step is to activate the CNT film using techniques such as disclosed in U.S. Pat. No. 7,452,735 and U.S. application Ser. No. 11/688,746, which are hereby incorporated by reference herein. Activation will re-arrange CNTs in such a way that they are more effective as electron emitters. One way this is achieved is by reducing electrical screening between the CNT emitters and by freeing the CNT fibers enough so that they align with the applied electrical field.

Fabrication of CNT Charging Units

After depositing CNT films on metal mesh substrates, a charging unit is fabricated by using one CNT coated mesh (shown in 9*a*)), one conducting or metal (e.g., stainless steel) plate with orifices (shown in (b)), and isolating spacers, as shown in FIG. 4. The spacing distance may range from 0.5-2.0 mm.

The basic atomization process overcomes the surface tension forces, making the surface of the liquid unstable and allowing it to form into ligaments and then droplets. See A. H. Lefebvre, Atomization and Spray, Taylor and Francis, ISBN 0-89116-603-3, 1989. For electrostatic atomization, this disruption is achieved by a repulsive force acting between like charges on the surface of the liquid (see Jeffrey Allen and Paul Ravenhill, SEA 2005, Paper 2005-32-0090). For droplet sizes larger than one micron, the size of the droplet is dependent on the amount of charge in the liquid forming the droplet (A. J. Kelly, R&D innovator, Vol. 3, No. 8, Article #113 (1994)).

FIG. 5 illustrates a CNT charging unit is positioned in front of a fuel injector. A high DC voltage is applied on the CNT coated mesh to charge the fuel stream when it passes. Then the charged stream goes through a grounded metal cage on which an electrical field-meter is assembled. Based on the electrical field measured, one can calculate how much charge has been transported to the fuel stream by the charging unit.

The device is operated by placing an electrical bias between the two electrodes leading to the CNT-coated mesh and metal plate with holes. The electrical bias may be continuous in one direction (+ on one electrode and —on the other electrode) or in a pulsed mode or in an AC mode (polarity switching from one electrode to the other). In continuous mode, the bias polarity may be with the CNT-coated mesh biased negative (−) with respect to the conducting plate.

Other configurations of the assembly shown in FIG. 5 are also possible. It is possible to reverse the placement of the CNT-coated mesh with the conductive plate. It is also possible to have the mesh and the conductive plate in the positions as shown in FIG. 5, but with the CNT coating on the conductive plate instead of on the mesh. In this case, the CNT coating can be on both sides of the plate and inside the hole but it is important that at least the side facing the mesh is coated with CNTs. In both of these alternative configurations, the bias polarity may be with the CNT-coated part (either mesh or conducting plate) biased negative (−) with respect to the other electrode.

Figure 6:
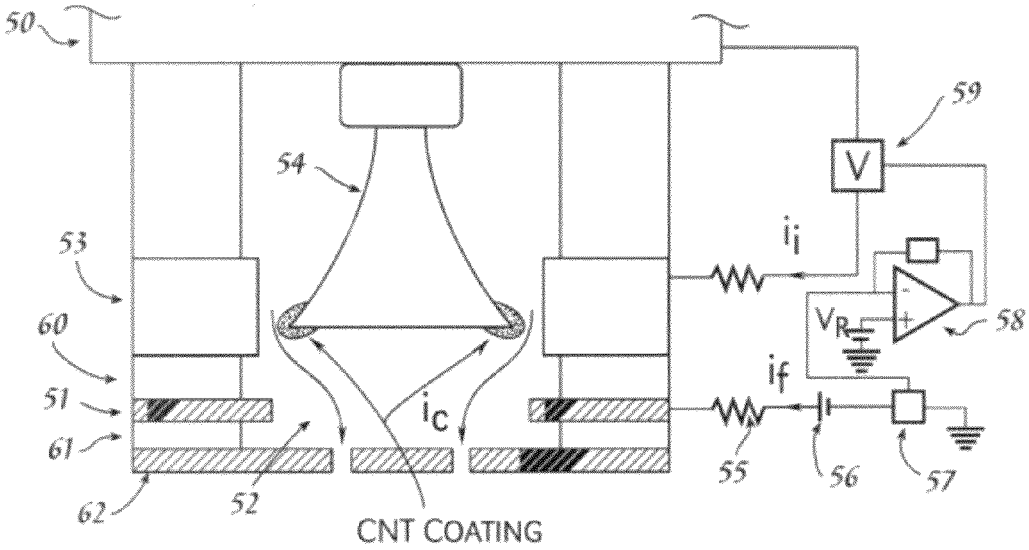
FIG. 6 illustrates a fuel injector configured in accordance with an embodiment of the present invention.

FIG. 6 illustrates a fuel injector 50 configured in accordance with an embodiment of the present invention, in which an annular electrode 51, separated by an insulating spacer layer 60 from an anode 53, surrounds the flow in a region 52 downstream of anode 53 and the cathode 54. Electrode 51 is connected to ground successively through a resistor 55, a voltage source 56, and an ammeter 57 equipped with an electrical output capable of providing a feedback voltage proportional to the current. Because of the large density of monopolar charge existing throughout the volume of the insulating fluid, a negative potential exists in region 52, which increases in magnitude with increasing distance along the flow path. This phenomena is similar to that occurring in a van de Graaf generator in which monopolar charge is transported to a distant location where a potential builds up (usually at a stress distributing sphere in the case of a generator). The magnitude of the potential increases with increasing space charge density, and thus when $i_i$ is increasing, provided f is kept at a constant value. Electrode 51 will come to equilibrium with the potential existing at its downstream position. Current $i_f$ for feedback purposes can then be drawn from electrode 51 through resistor 55. This current will be proportional to the potential at electrode 51 and thus to the current $i_c$ (the current injected into the flowing fuel and exits the injector through the nozzle). Voltage source 56 may be inserted into the circuit to modify the current level to desirable values whereby the measured current will still be proportional to current $i_c$. The values of voltage source 56 and resistor 55 may be adjusted so that $i_f$ is much less than $i_c$. For calibration purposes, measurements can be made to correlate measured values of $i_f$ with corresponding values of $i_c$. With this measured correlation, the output of ammeter 57 can then be used as the negative input of a negative feedback amplifier 58 with appropriate feedback impedance and filter circuitry. The other input of amplifier 58 is a reference voltage $V_r$ which represents the desired value of $i_c$ through the previously established correlation table. The output of feedback amplifier 58 is then fed back to control the output of the anode-cathode supply voltage 59 at a value which will maintain electrode current $i_f$ at the desired value. Electrode 51 may be separated from the nozzle 62 by another insulating layer 61. Cathode 54 acts as the source of electrons injected into the fluid passing between cathode 54 and anode 53, much like the CNT-coated mesh acts as a source of electrons in FIG. 5. The highest field on the surface of cathode 54 is the region closest to anode 53. By coating the rim of the cathode 54 with CNT, the electrical field is increased as a result of the high aspect ratio of the CNT fibers in the coating. This results in more current being injected into the fluid and may also allow the gap between the cathode 54 and the anode 53 to be larger while maintaining the same charge injection current. Further descriptions can be found in U.S. Pat. No. 5,725,151, which is hereby incorporated by reference herein.

We claim:

1. A fuel injector apparatus comprising:

a fuel injector nozzle configured for passage of a fuel for energizing an engine; and a charging unit coupled to the fuel injector, the charging unit configured for atomizing the fuel from the fuel injector, the charging unit further comprising:

a conductive mesh substrate coated with a carbon nanotube film;

a conductive plate with one or more orifices there through;

one or more spacers for positioning the conductive mesh substrate a distance from the conductive plate; and electronics configured for applying an electrical bias between the conductive mesh substrate and the conductive plate to thereby electrostatically charge the fuel causing repulsive forces on surfaces of liquid in the fuel resulting in the liquid splitting into droplets.

2. The fuel injector apparatus as recited in claim 1, wherein the conductive mesh substrate and the conductive plate are parallel to each other in a coaxial relationship with an outlet of the fuel injector.

3. The fuel injector apparatus as recited in claim 2, wherein the electronics are configured for applying a DC voltage to the conductive mesh substrate and the conductive plate.

4. The fuel injector apparatus as recited in claim 2, wherein the electronics are configured for applying an AC voltage to the conductive mesh substrate and the conductive plate.

5. The fuel injector apparatus as recited in claim 2, wherein the electronics are configured to apply the electrical bias in a pulsed mode.

6. A method for atomizing a liquid fuel for use in an engine, comprising:

passing the liquid fuel through a fuel injector nozzle to a charging unit coupled to an outlet of the fuel injector, the charging unit further comprising a conductive mesh substrate coated with a carbon nanotube film, a conductive plate with one or more orifices there through, and one or more spacers for positioning the conductive mesh substrate a distance from the conductive plate; and applying an electrical bias between the conductive mesh substrate and the conductive plate to thereby electrostatically charge the liquid fuel causing repulsive forces on surfaces of the liquid fuel resulting in the liquid fuel splitting into smaller droplets.

7. The method as recited in claim 6, further comprising positioning the conductive mesh substrate and the conductive plate parallel to each other in a coaxial relationship with the outlet of the fuel injector.

8. The method as recited in claim 6, wherein the electrical bias applies a DC voltage between the conductive mesh substrate and the conductive plate.

9. The method as recited in claim 6, wherein the electrical bias applies an AC voltage between the conductive mesh substrate and the conductive plate.

10. The method as recited in claim 6, wherein the electrical bias is applied. in a pulsed mode.

* * * * *